US008020380B2

(12) United States Patent
Oda et al.

(10) Patent No.: US 8,020,380 B2
(45) Date of Patent: Sep. 20, 2011

(54) EXTERNAL COMBUSTION ENGINE

(75) Inventors: Shuzo Oda, Kariya (JP); Shinichi Yatsuzuka, Nagoya (JP); Yasunori Niiyama, Kuwana (JP); Takashi Kaneko, Nagoya (JP); Shunji Okemoto, Tokai (JP)

(73) Assignee: Denso Corporation, Kariya (JP)

( * ) Notice: Subject to any disclaimer, the term of this patent is extended or adjusted under 35 U.S.C. 154(b) by 421 days.

(21) Appl. No.: 12/322,869

(22) Filed: Feb. 6, 2009

(65) Prior Publication Data

US 2009/0199559 A1 Aug. 13, 2009

(30) Foreign Application Priority Data

Feb. 7, 2008 (JP) ..... 2008-027562

(51) Int. Cl.
*F01B 1/00* (2006.01)

(52) U.S. Cl. ..... 60/508; 60/531; 60/670; 60/39.6

(58) Field of Classification Search ..... 60/39.6, 60/39.63, 508, 530, 531, 670
See application file for complete search history.

(56) References Cited

U.S. PATENT DOCUMENTS

| | | | | |
|---|---|---|---|---|
| 7,415,824 | B2 * | 8/2008 | Komaki et al. | 60/508 |
| 7,424,802 | B2 * | 9/2008 | Yatsuzuka et al. | 60/508 |
| 7,493,751 | B2 * | 2/2009 | Oda et al. | 60/39.6 |
| 7,493,760 | B2 * | 2/2009 | Oda et al. | 60/508 |
| 7,574,861 | B2 * | 8/2009 | Niiyama et al. | 60/531 |
| 7,644,582 | B2 * | 1/2010 | Yatsuzuka et al. | 60/531 |
| 2005/0257524 | A1 | 11/2005 | Yatsuzuka et al. | |
| 2008/0307790 | A1 | 12/2008 | Yatsuzuka et al. | |

FOREIGN PATENT DOCUMENTS

| | | |
|---|---|---|
| JP | 04-059355 | 5/1992 |
| JP | 05-272406 | 10/1993 |
| JP | 07-310591 | 11/1995 |
| JP | 10-213012 | 8/1998 |
| JP | 10-252557 | 9/1998 |
| JP | 2005-330885 | 12/2005 |

OTHER PUBLICATIONS

Office action dated Nov. 24, 2009 in corresponding Japanese Application No. 2008-027562.

* cited by examiner

*Primary Examiner* — Hoang M Nguyen
(74) *Attorney, Agent, or Firm* — Harness, Dickey & Pierce, PLC

(57) ABSTRACT

An external combustion engine alternately repeating a first stroke of making a working fluid evaporate at a plurality of heating portions and making a liquid phase part of the working fluid displace toward an output part side and a second stroke of making the working fluid evaporated at the first stroke condense at the plurality of cooling portions and making the liquid phase part of the working fluid displace toward the side of the plurality of the heating portions and provided with inflow adjusting means for reducing differences in inflows among the plurality of the heating portions, wherein the inflow is defined as the amount of a liquid phase part of the working fluid flowing into the heating portions when the liquid phase part of the working fluid displaces from the output part side to the side of the plurality of the heating portions in the second stroke.

8 Claims, 5 Drawing Sheets

EXTERNAL COMBUSTION ENGINE

BACKGROUND OF THE INVENTION

1. Field of the Invention

The present invention relates to an external combustion engine using evaporation and condensation of a working fluid to cause a liquid phase part of the working fluid to displace, and converting the displacement of the liquid phase part of the working fluid to mechanical energy for output.

2. Description of the Related Art

In the past, one external combustion engine was disclosed in Japanese Patent Publication (A) No. 2005-330885. In such an external combustion engine, a container in which a working fluid is sealed flowable in the liquid phase state, is formed with a heating portion heating part of the liquid phase state working fluid to evaporate it, and a cooling portion cooling the working fluid evaporated at the heating portion to condense it.

By alternately repeating this evaporation and condensation of the working fluid, the liquid phase part of the working fluid is made to cyclically displace, and the vibration of the liquid phase part of the working fluid is taken out at the output part as mechanical energy.

In the prior art, the part of the container at the output part side is formed by a single merging pipe and the parts of the container forming the heating portion and cooling portion are formed by large numbers of branch pipes so as to increase the heat conduction areas of the heating portion and cooling portion. Due to this, the heating efficiency (evaporation efficiency) and cooling efficiency (condensation efficiency) of the working fluid are improved to increase the output of the external combustion engine.

In the above prior art, when the liquid phase state working fluid did not sufficiently reach the heating portion, the heating efficiency (evaporation efficiency) of the working fluid could fall and in turn the output of the external combustion engine could fall.

In the above prior art, the part of the container at the output part side was formed by a single merging pipe, while the parts of the container forming the heating portion and cooling portion were formed by large numbers of branch pipes. According to detailed studies of the inventors, branch pipes where the liquid phase state working fluid will easily reach the heating portion and branch pipes where the liquid phase state working fluid will have a hard time reaching the heating portion end up being formed and, as a result, the output of the external combustion engine can be lowered. Such a state occurs not only when there are large numbers of branch pipes, but also when there are two branch pipes.

SUMMARY OF THE INVENTION

An object of the present invention, in view of this point, is to improve the heating efficiency of a working fluid by a plurality of heating portions.

To achieve the above object, in the external combustion engine as set forth in claim 1, there is provided an external combustion engine comprising a container having one merging pipe, a plurality of branch pipes, and a branched part branching from said merging pipe toward said plurality of branch pipes and having a working fluid sealed inside it flowable in the liquid phase state, a plurality of heating portions heating and evaporating part of said working fluid in a liquid phase state, formed at said container to correspond to said plurality of branch pipes, and communicated with the ends of said plurality of branch pipes at the sides opposite to said branched part, a plurality of cooling portions cooling and condensing said working fluid evaporated at said heating portions, formed at said plurality of branch pipes, and an output part converting displacement of the liquid phase part of said working fluid to mechanical energy, communicated with an end of said merging pipe at a side opposite to said branched part, said external combustion engine alternately repeating a first stroke of making said working fluid evaporate at said plurality of heating portions and making the liquid phase part of said working fluid displace toward said output part side and a second stroke of making said working fluid evaporated at said first stroke condense at said plurality of cooling portions and making the liquid phase part of said working fluid displace toward the side of said plurality of the heating portions, and further comprising inflow adjusting means for reducing differences in inflows among said plurality of the heating portions, wherein the inflow is defined as the amount of a liquid phase part of said working fluid flowing into the heating portions when the liquid phase part of said working fluid displaces from said output part side to the side of said plurality of the heating portions in said second stroke.

Due to this, it is possible to equalize the inflow of the liquid phase state working fluid to the plurality of the heating portions, so it is possible to improve the heating efficiency (evaporation efficiency) of the working fluid and possible to increase the output of the external combustion engine.

In the invention described in claim 2, there is provided the external combustion engine as set forth in claim 1, wherein said inflow adjusting means are formed so that flow resistances of the plurality of flow paths from the end of said blanched part at said merging pipe side to the end thereof at the side of said plurality of branch pipes respectively become the same.

The description "flow resistances of the plurality of flow paths become the same" in this specification does not mean only the flow resistances of the plurality of flow paths strictly becoming the same and is used in the sense including cases where manufacturing error etc. results in the flow resistances of the plurality of flow paths slightly differing.

In the invention described in claim 3, there is provided the external combustion engine as set forth in claim 2, wherein said plurality of flow paths of said branched part become mutually symmetric shapes so that the flow resistances of said plurality of flow paths respectively become the same.

In the invention described in claim 4, there is provided the external combustion engine as set forth in claim 1, wherein said inflow adjusting means are formed so that the flow resistance of said branched part is made smaller than the flow resistances of said cooling portions.

In the invention described in claim 5, there is provided the external combustion engine as set forth in claim 4, wherein a length $l_{in}$ of the branched part, a hydraulic diameter $d_{in}$ of a flow path of the branched part, a length $l_r$ of the cooling portions, and a hydraulic diameter $d_r$ of a flow path of the cooling portions satisfy the following relationship:

$$l_{in}/d_{in}<l_r/d_r$$

where, $l_{in}$: length of branched part $d_{in}$: hydraulic diameter of flow path of branched part $l_r$: length of cooling portions $d_r$: hydraulic diameter of flow paths of cooling portions.

In the invention described in claim 6, there is provided the external combustion engine as set forth in claim 1, wherein said plurality of branch pipes are provided with flow resistance adjusting means for making a flow resistance of a branch pipe at the side close to said output part larger than a flow resistance of a branch pipe at the side far from said output part, and said inflow adjusting means are said flow resistance adjusting means.

In the invention described in claim 7, there is provided the external combustion engine as set forth in claim 6, wherein said plurality of branch pipes are provided with venturi, a resistance value of a venturi provided in a branch pipe at the side close to said output part is made larger than a resistance value of a venturi provided in a branch pipe at the side far from said output part, and said flow resistance adjusting means are said venturi.

In the invention described in claim 8, there is provided the external combustion engine as set forth in claim 1, wherein at said plurality of heating portions, said inflow adjusting means are formed so that a heating portion at the side close to said output part is positioned above a heating portion at the side far from said output part.

BRIEF DESCRIPTION OF THE DRAWINGS

These and other objects and features of the present invention will become clearer from the following description of the preferred embodiments given with reference to the attached drawings, wherein:

FIG. 4A is an enlarged view of part A of FIG. 3, while

DESCRIPTION OF THE PREFERRED EMBODIMENTS

First Embodiment

Figure 1:
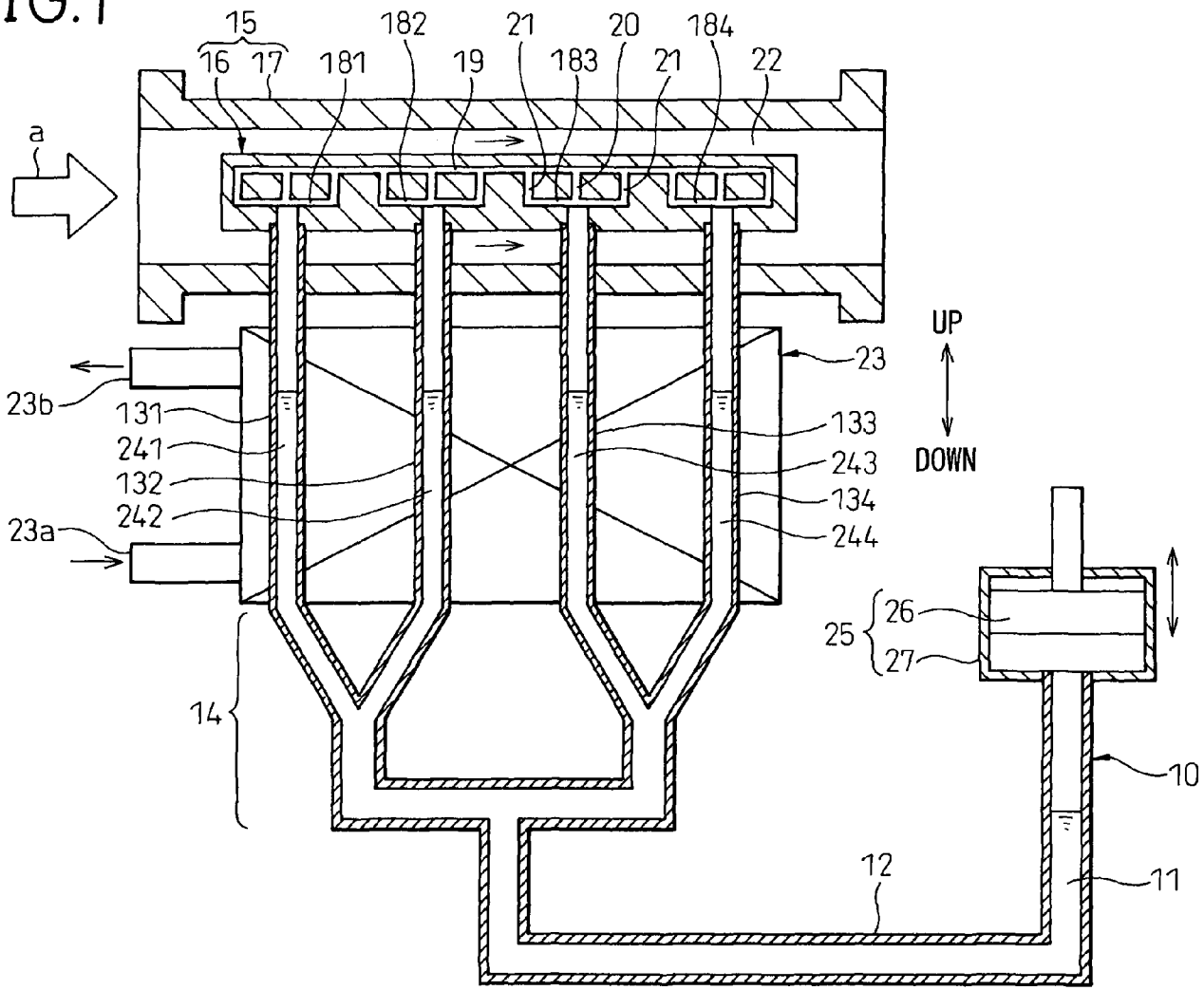
FIG. 1 is a cross-sectional view showing the schematic configuration of an external combustion engine according to a first embodiment of the present invention.

Below, a first embodiment of the present invention will be explained based on FIG. 1. The external combustion engine according to the present invention is also called a "liquid piston type steam engine". This engine is, for example, used as a drive source for an electrical generator. FIG. 1 is a view showing the schematic configuration of an external combustion engine according to the present embodiment. The up and down arrows in FIG. 1 show the up-down directions in the installed state of the external combustion engine.

The container 10 is a pipe-shaped pressure container in which the working fluid (in the present embodiment, water) 11 is sealed flowable in the liquid phase state and has one merging pipe 12 positioned at one end side of the container 10, four branch pipes 131 to 134 positioned at the other end side of the container 10, and a branched part 14 branching from the merging pipe 12 to the four branch pipes 131 to 134. In the present embodiment, the merging pipe 12, branch pipes 131 to 134, and branched part 14 are formed by stainless steel.

The merging pipe 12 is formed into a substantial U-shape. It is arranged so that the two ends face upward. The four branch pipes 131 to 134 are formed into straight shapes. The branch pipes are arranged so that their longitudinal directions are parallel with the direction of gravity (up-down direction). The four branch pipes 131 to 134 have the same shapes and same dimensions. In the present embodiment, they are pipes of the same lengths and same inside diameters.

The branched part 14 is branched symmetrically into two limbs from one end of the merging pipe 12, then is further branched symmetrically into two limbs at each limb and is connected to the bottom ends of the branch pipes 131 to 134. The branched part 14 is shaped geometrically symmetric. That is, the four flow paths from the single end of the merging pipe 12 to the four bottom ends of the branch pipes 131 to 134 are shaped symmetrically. Therefore, the flow resistances of the four flow paths become the same.

The top ends of the branch pipes 131 to 134 are connected to a heat exchanger 15 exchanging heat between the working fluid 11 and the high temperature gas. The heat exchanger 15 is comprised of a box-shaped block member 16 and a case 17 housing the block member 16.

The block member 16 forms part of the container 10 and is formed by copper, aluminum, or other material superior in coefficient of thermal conductivity. The longitudinal direction of the block member 16 faces the direction of arrangement of the four branch pipes 131 to 134 (lateral direction of FIG. 1).

While not shown, for convenience in molding, the block member 16 is divided into a plurality of mating parts, then the plurality of mating parts are fastened together by screws or other fastening means.

Inside the block member 16, the hollow parts are formed in communication with the four branch pipes 131 to 134. Parts of the hollow parts form four heating portions 181 to 184, which heat and evaporate part of the liquid phase state working fluid 11.

The four heating portions 181 to 184 are disk-shaped spaces, which are provided corresponding to the four branch pipes 131 to 134. The axial centers of the disk-shaped heating portions 181 to 184 and the axial centers of the branch pipes 131 to 134 are arranged coaxially.

Among the hollow parts inside the block member 16, the parts positioned above the heating portions 181 to 184 form a steam reservoir 19 storing the steam of the working fluid 11 generated at the heating portions 181 to 184.

This steam reservoir 19 extends in parallel to the direction of arrangement of the heating portions 181 to 184 (lateral direction in FIG. 1) and is communicated with the four heating portions 181 to 184 through communicating paths 20 and 21. The communicating paths 20 extend from the centers of the disk-shaped heating portions 181 to 184 to the top direction, while the communicating paths 21 extend from the outer circumferences of the disk-shaped heating portions 181 to 184 to the top direction.

A gas serving as an additional medium is sealed inside the steam reservoir 19 in a predetermined volume. As the additional medium, it is possible to select a medium maintaining a gas phase state under the operating condition of the external combustion engine. Therefore, the gas serving as the additional medium may for example be the easy-to-handle air or pure steam of the working fluid 11.

The case 17 extends in the longitudinal direction of the block member 16 (lateral direction of FIG. 1). At the two ends of the case 17, gas pipes (not shown) through which high temperature gas (high temperature fluid) serving as a heat source flows, are connected. The space formed between the outer surface of the block member 16 and the inside wall surface of the case 17 forms a gas flow path 22 through which the high temperature gas flows.

The gas flow path 22 inside the case 17 is provided with heat conduction fins (not shown) for increasing the heat conduction area between the block member 16 and the high temperature gas.

At the outer circumference of the bottom ends of the branch pipes 131 to 134, a cooler 23 through which cooling water is circulated is arranged in contact with the pipes for heat conduction. The inside spaces of the branch pipes 131 to 134 in contact with the cooler 23 form cooling portions 241 to 244 for cooling and condensing the working fluid 11 evaporated at the heating portions 181 to 184.

Therefore, by cooling water circulating in the cooler 23, the portions of the branch pipes 131 to 134 in contact with the cooler 23 are cooled. Due to this, the working fluid 11 is cooled at the cooling portions 241 to 244.

The cooling water inlet 23*a* and cooling water outlet 23*b* of the cooler 23 are connected to a circulation path of cooling water. A radiator (not shown) is arranged in the circulation path of the cooling water. Due to this, the heat which the cooling water robs from the steam of the working fluid 11 is radiated by the radiator into the atmosphere. The portions of the branch pipes 131 to 134 in contact with the cooler 23 may be formed by copper or aluminum superior in coefficient of thermal conductivity.

The other end of the merging pipe 12 is communicated with the output part 25. The output part 25 has a piston 26 displacing upon receiving pressure from the liquid phase part of the working fluid 11 and a cylinder 27 supporting the piston 26 in a slidable manner.

Next, the operation in the above configuration will be briefly explained.

First, when the working fluid (water) 11 in the heating portions 181 to 184 is heated and vaporized, high temperature and high pressure steam of the working fluid 11 is built up in the steam reservoir 19 and the heating portions 181 to 184 and the level of the working fluid 11 is pushed down in the branch pipes 131 to 134.

This being the case, the liquid phase part of the working fluid 11 is pushed from the side of the heating portions 181 to 184 to the side of the output part 25 and the piston 26 of the output part 25 is pushed up (first stroke).

Next, when the level of the working fluid 11 in the branch pipes 131 to 134 falls to the cooling portions 241 to 244 and steam of the working fluid 11 enters the cooling portions 241 to 244, the steam of the working fluid 11 is cooled by the cooling portions 241 to 244 and condensed. For this reason, the force pushing down the level of the working fluid 11 is eliminated and the force pushing up the piston 26 is also eliminated.

The pushed up piston 26 at the output part 25 side descends, the liquid phase part of the working fluid 11 is pushed back from the output part 25 side to the heating portion 181 to 184 side, and the level of the working fluid 11 rises to the heating portions 181 to 184 (second stroke).

By repetition of this operation, the liquid phase part of the working fluid 11 in the container 10 cyclically displaces (so-called self excited vibration) and the piston 26 of the output part 25 is made to cyclically move up and down.

That is, by alternately repeating the evaporation and condensation of the working fluid 11, the liquid phase part of the working fluid 11 displaces like a piston. This displacement of the liquid phase part of the working fluid 11 is converted to mechanical energy and output at the output part 25.

In the present embodiment, the branched part 14 is made geometrically symmetric and the flow resistances of the four flow paths from the single end of the merging pipe 12 to the four ends of the branch pipes 131 to 134 at the branched part 14 are made the same.

For this reason, the liquid phase state working fluid 11 can be made to equally reach the four heating portions 181 to 184, so the heating performance (evaporation performance) of the working fluid 11 can be improved and in turn the output of the external combustion engine can be increased.

As will be understood from the above explanation, the present embodiment forms the branched part 14 to be geometrically symmetrical. Due to this, the inflow adjusting means of the present invention is formed by making the flow resistances of the four flow paths from the single end of the merging pipe 12 to the four ends of the branch pipes 131 to 134 at the branched part 14 the same.

Second Embodiment

Figure 2:
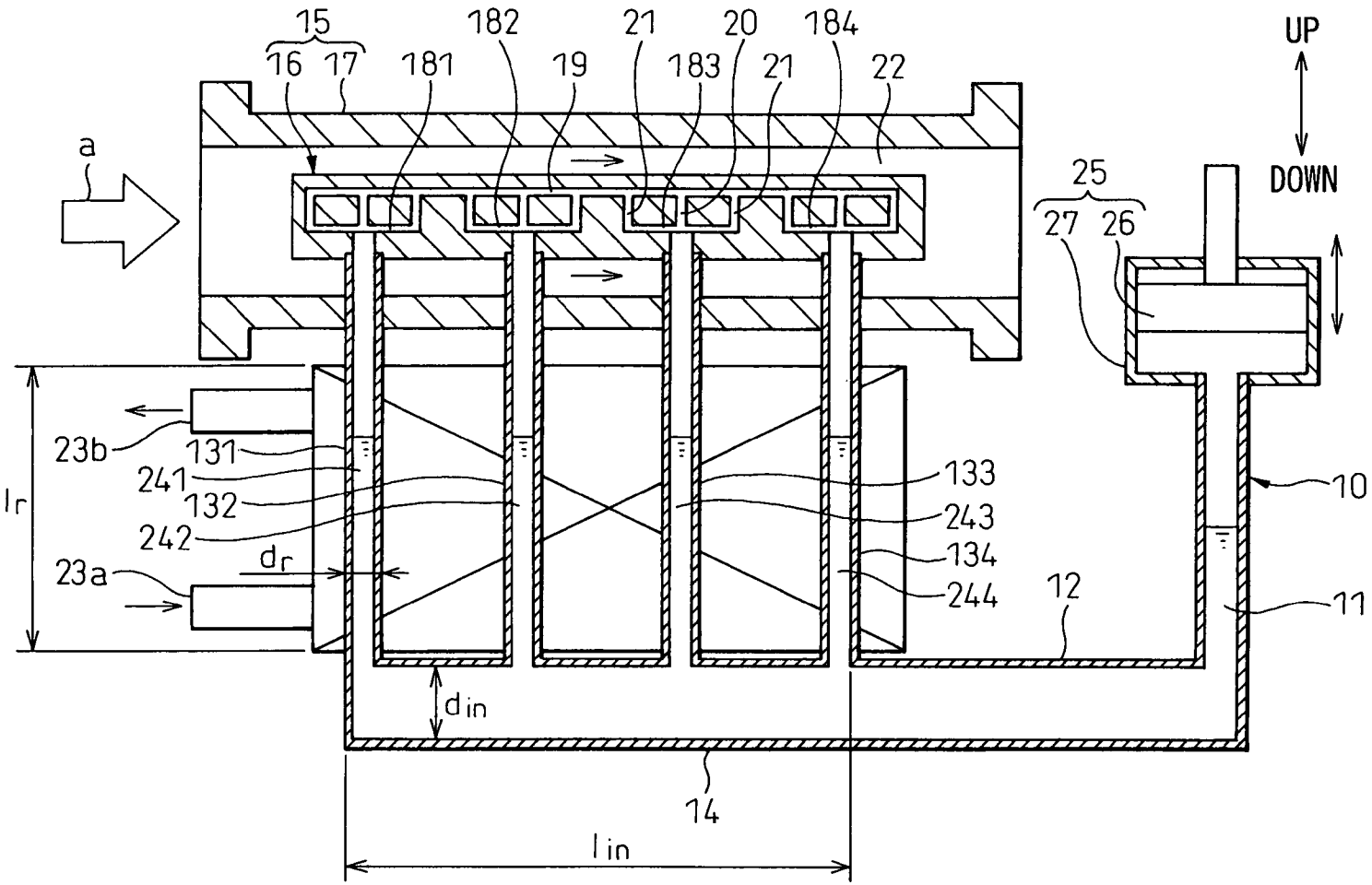
FIG. 2 is a cross-sectional view showing the schematic configuration of an external combustion engine according to a second embodiment of the present invention.

The first embodiment forms the branched part 14 to be geometrically symmetric, but in the second embodiment, as shown in FIG. 2, the flow resistance of the branched part 14 is made smaller than the flow resistance of the cooling portions 241 to 244.

In the present embodiment, the merging pipe 12 is formed into a substantially L-shape. The end of the merging pipe 12 at the output part 25 side faces upward, while the other end thereof is arranged to face the direction of arrangement of the branch pipes 131 to 134 (lateral direction of FIG. 1).

The branched part 14 is formed in a straight shape and is arranged so that its longitudinal direction becomes parallel to the direction of arrangement of the branch pipes 131 to 134 (lateral direction of FIG. 1). In the present embodiment, the cross-sectional shape of the flow path of the branched part 14 is circular, but it is not necessarily limited to a circular shape and may also be noncircular.

Further, the length $l_{in}$ of the branched part 14, the hydraulic diameter $d_{in}$ of the flow path of the branched part 14, the length $l_r$ of the cooling portions 241 to 244, and the hydraulic diameter $d_r$ of the flow path of the cooling portions 241 to 244 satisfy the following relationship:

$$l_{in}/d_{in}<l_r/d_r$$

The hydraulic diameter of the flow path is the diameter when converting the cross-sectional shape of the flow path to a circle and is expressed by the following formula:

$$d_e=4\times S/L$$

where, $d_e$ is the hydraulic diameter, S is the sectional area of the flow path (corresponding to sectional area of circle), L is the length of the wetted perimeter (corresponding to circumference).

In the present embodiment, the cross-sectional shape of the flow path of the branched part 14 is circular, so the hydraulic diameter $d_{in}$ of the flow path of the branched part 14 is the same as the inside diameter of the branched part 14. The hydraulic diameters $d_r$ of the flow paths of the cooling portions 241 to 244 are the same as the inside diameters of the cooling portions 241 to 244.

According to the present embodiment, the flow resistance of the branched part 14 becomes smaller than the flow resistances of the cooling portions 241 to 244, so compared with the case where the flow resistance of the branched part 14 is the same as the flow resistances of the cooling portions 241 to 244, it is possible to equalize the inflow of the liquid phase state working fluid 11 to the cooling portions 241 to 244.

As a result, in the same way as the above first embodiment, it is possible to equalize the inflow of the working fluid 11 in the liquid phase state to the four heating portions 181 to 184 and, in turn, increase the output of the external combustion engine.

Third Embodiment

Figure 3:
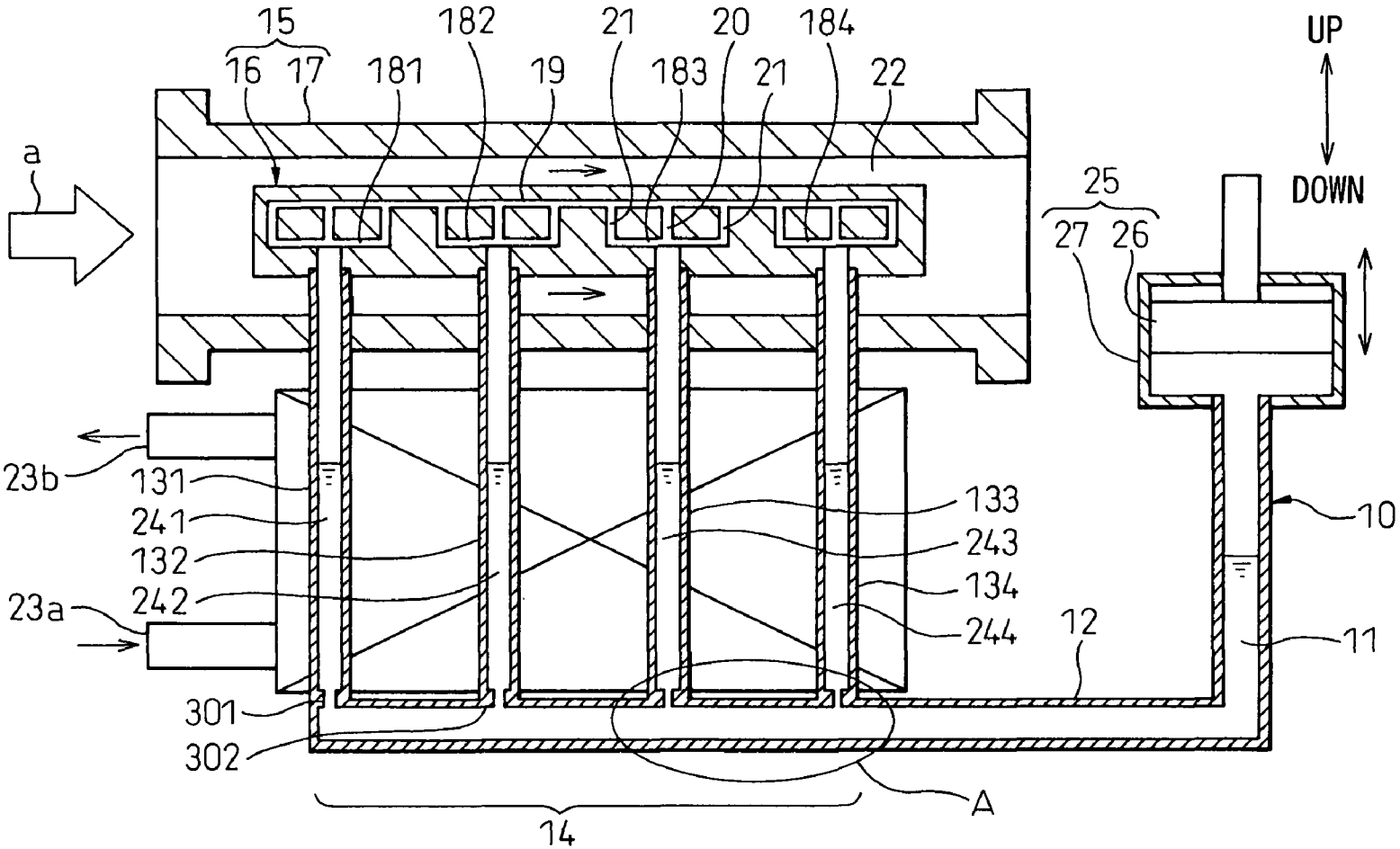
FIG. 3 is a cross-sectional view showing the schematic configuration of an external combustion engine according to a third embodiment of the present invention.
Figure 4A:
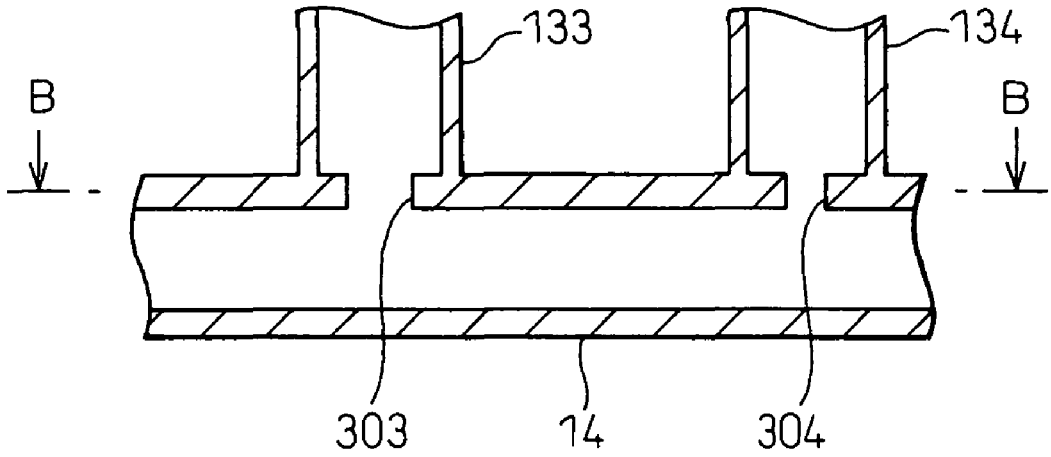
Figure 4B:
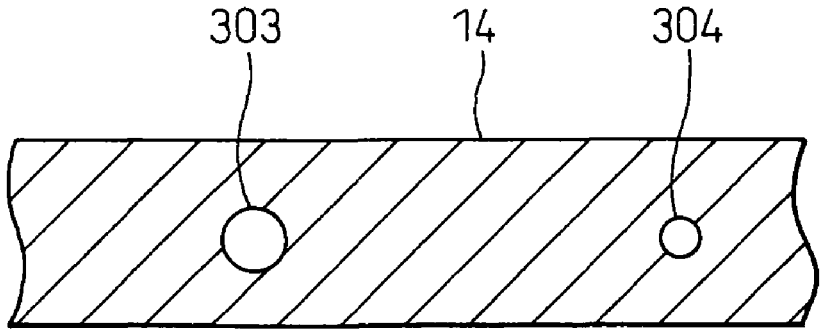
FIG. 4B is a cross-sectional view along the line B-B of FIG. 4A.

In the above second embodiment, the flow resistance of the branched part 14 is made smaller than the flow resistances of the cooling portions 241 to 244, but in the third embodiment, as shown in FIG. 3, FIG. 4A and FIG. 4B, among the branch pipes 131 to 134, a flow resistance of a branch pipe at the side close to the output part 25 is made larger than a flow resistance of a branch pipe at the side far from the output part 25.

Specifically, the bottom ends of the branch pipes 131 to 134 are provided with venturi 301 to 304. The resistance values of the venturi 301 to 304 are set to become larger the further from the venturi 301 farthest from the output part 25 toward the venturi closest to the output part 25. The venturi 301 to 304 correspond to the flow resistance adjusting means in the present invention.

In the present embodiment, fixed venturi are used as the venturi 301 to 304, so the venturi diameters of the venturi 301 to 304 are set to become smaller along the flow path of the branched part 14 from the venturi 301 farthest from the output part 25 toward the venturi 304 closest to the output part 25.

In the present embodiment, the flow resistance of the branched part 14 becomes substantially the same as the flow resistances of the cooling portions 241 to 244.

According to the present embodiment, at the branch pipes 131 to 134, a flow resistance of a branch pipe at the side close to the output part 25 becomes larger than a flow resistance of a branch pipe at the side far from the output part 25, so inflow of the liquid phase state working fluid 11 to a branch pipe at the side close to the output part 25 is suppressed.

For this reason, compared with the case where the flow resistances of the branch pipes 131 to 134 are the same as each other, it is possible to equalize the inflow of the liquid phase state working fluid 11 to the branch pipes 131 to 134.

As a result, in the same way as the above first embodiment, it is possible to equalize the inflow of the liquid phase state working fluid 11 to the four heating portions 181 to 184 and in turn possible to increase the output of the external combustion engine.

The higher the drive frequency of the external combustion engine becomes, the greater the difference between the inflow of the working fluid 11 to a branch pipe at the side close to the output part 25, and the inflow of the working fluid 11 to a branch pipe at the side far from the output part 25 becomes.

In consideration of this point, for external combustion engines set with high drive frequencies, the difference between a resistance value of a venturi of the side close to the output part 25 and a resistance value of a venturi of the side far from the output part 25 is preferably set large.

In the present embodiment, fixed venturi are used as the venturi 301 to 304, but it is also possible to use variable venturi as the venturi 301 to 304.

When using variable venturi as the venturi 301 to 304, the difference between a resistance value of a venturi of the side close to the output part 25 and a resistance value of a venturi of the side far from the output part 25 can be changed in accordance with fluctuation of the drive frequency of the external combustion engine accompanying load fluctuations at the output part 25 side.

In this case, as the venturi 301 to 30, electrical type variable venturi are used. When the drive frequency of the external combustion engine is low, the difference between a resistance value of a venturi of the side close to the output part 25 and a resistance value of a venturi of the side far from the output part 25 is controlled to become smaller, while when the drive frequency of the external combustion engine is high, the difference between a resistance value of a venturi of the side close to the output part 25 and a resistance value of a venturi of the side far from the output part 25 is controlled to become larger.

Further, in the present embodiment, the venturi 301 to 304 are arranged at the bottom ends of the branch pipes 131 to 134, but it is not necessary required that they be arranged at the bottom ends. It is possible to arrange the venturi 301 to 304 at any locations of the branch pipes 131 to 134.

Further, in the present embodiment, all branch pipes 131 to 134 are provided with venturi 301 to 304. The venturi 301 to 304 form the flow resistance adjusting means in the present invention, but it is not necessarily required that all branch pipes 131 to 134 be provided with venturi. It is also possible to have only the branch pipe at the side close to the output part 25 provided with a venturi and have the branch pipe at the side far from the output part 25 not provided with a venturi so as to form the flow resistance adjusting means in the present invention.

Fourth Embodiment

In the above third embodiment, among the branch pipes 131 to 134, a flow resistance of a branch pipe at the side close to the output part 25 is made larger than a flow resistance of a branch pipe at the side far from the output part 25.

Figure 5:
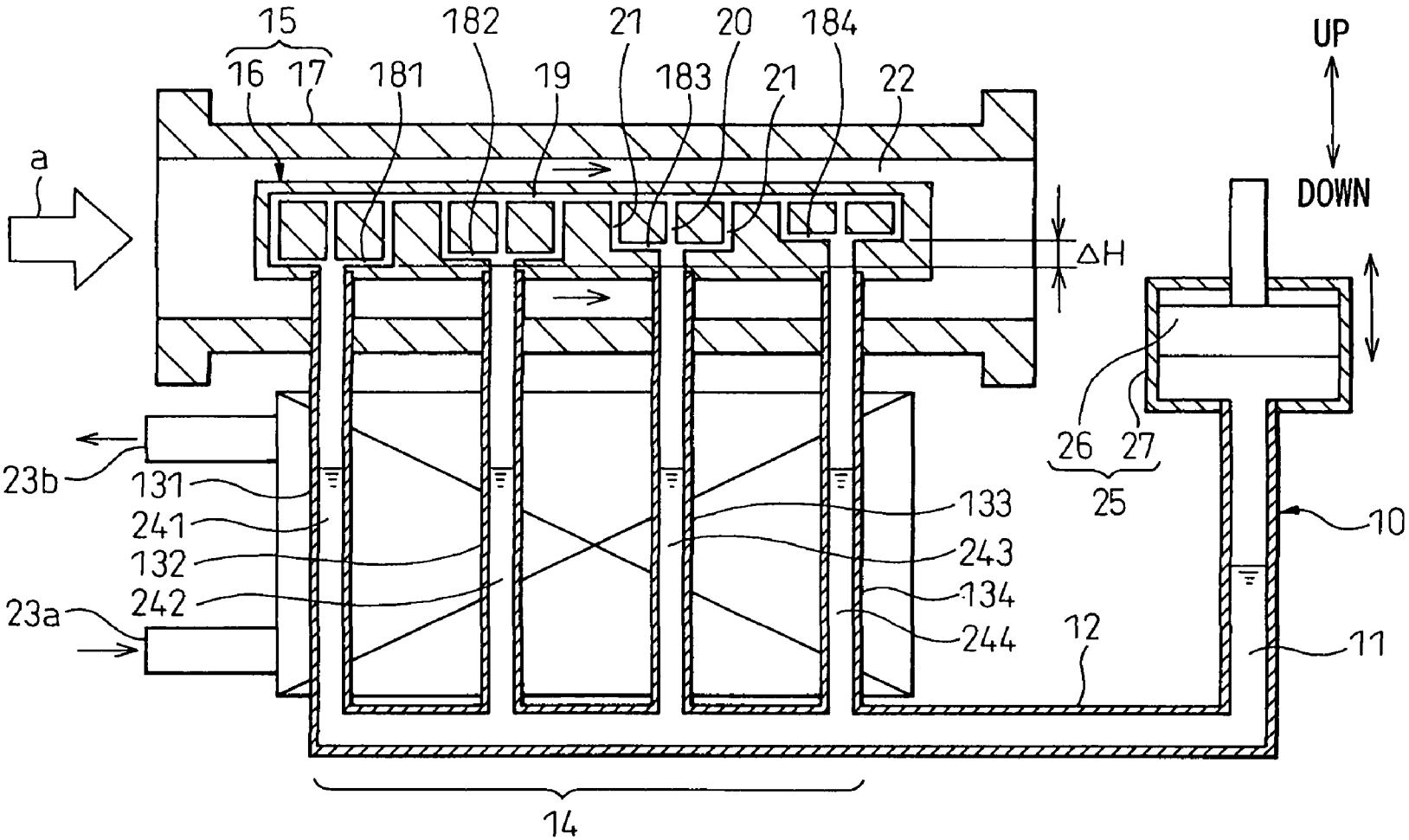
FIG. 5 is a cross-sectional view showing the schematic configuration of an external combustion engine according to a fourth embodiment of the present invention.

On the other hand, in the fourth embodiment, as shown in FIG. 5, among the heating portions 181 to 184, a heating portion at the side close to the output part 25 is arranged at a position higher than a heating portion at the side far from the output part 25. In FIG. 5, the dimension AH shows the difference in heights of the arrangement positions between the heating portion 181 farthest from the output part 25 and the heating portion 184 closest to the output part 25.

In the present embodiment, the placement heights of the heating portions 181 to 184 become higher from the heating portion 181 farthest from the output part 25 toward the heat portion 184 closest to the output part 25.

Due to this, compared with the case where the placement heights of the four heating portions 181 to 184 are made the same, it is possible to equalize the inflow of the liquid phase state working fluid 11 to the four heating portions 181 to 184 and, in turn, increase the output of the external combustion engine.

Preferably, by changing the heights of the heating portions 181 to 184 by exactly the difference in flow resistance at the branched part 14, the liquid phase state working fluid 11 may be made to flow equally to the four heating portions 181 to 184 and, in turn, possible to increase the output of the external combustion engine more.

Other Embodiments (1) In the above embodiments, the heating portions 181 to 184 are formed in disk shapes expanding in the horizontal direction with respect to the branch pipes 131 to 134, but the heating portions 181 to 184 can be changed in shape in various ways. For example, they may also be formed into cylindrical shapes extending upward with the same inside diameters as the branch pipes 131 to 134.

(2) In the above embodiments, four each of the branch pipes 131 to 134 and the heating portions 181 to 184 are formed, but it is also possible to provide any number of branch pipes and heating portions so long as two or more.

Further, in the above embodiments, the branch pipes 131 to 134 and the heating portions 181 to 184 are arranged in only the flow direction of the high temperature gas (lateral direction of FIG. 1 to FIG. 3 and FIG. 5), but it is also possible to arrange the branch pipes and the heating portions in not only the flow direction of the high temperature gas, but also the direction perpendicular to the flow direction of the high temperature gas (direction vertical to paper surface of FIG. 1 to FIG. 3 and FIG. 5). Due to this, it is possible to suppress the increase the volume of the external combustion engine, so it is possible to increase the number of the branch pipes and the heating portions.

(3) In the above embodiments, high temperature gas is used as the heat sources of the heating portions 181 to 184, but it is also possible to use various high temperature fluids as the heat sources of the heating portions 181 to 184.

Further, heating elements may also be used as the heat sources of the heating portions 181 to 184. In this case, the heating elements may be brought into contact with the block member 16 in a heat conductible manner, or the heating elements may be arranged in proximity at predetermined distances from the block member 16.

(4) The external combustion engine according to the present invention can be applied to not only the drive source of an electrical generator, but also the drive source of various other apparatuses.

While the invention has been described with reference to specific embodiments chosen for purpose of illustration, it should be apparent that numerous modifications could be made thereto by those skilled in the art without departing from the basic concept and scope of the invention.

The invention claimed is:

1. An external combustion engine comprising a container having one merging pipe, a plurality of branch pipes, and a branched part branching from said merging pipe toward said plurality of branch pipes and having a working fluid sealed inside it flowable in the liquid phase state, a plurality of heating portions heating and evaporating part of said working fluid in a liquid phase state, formed at said container to correspond to said plurality of branch pipes, and communicated with the ends of said plurality of branch pipes at the sides opposite to said branched part, a plurality of cooling portions cooling and condensing said working fluid evaporated at said heating portions, formed at said plurality of branch pipes, and an output part converting displacement of the liquid phase part of said working fluid to mechanical energy, communicated with an end of said merging pipe at a side opposite to said branched part, said external combustion engine alternately repeating a first stroke of making said working fluid evaporate at said plurality of heating portions and making the liquid phase part of said working fluid displace toward said output part side and a second stroke of making said working fluid evaporated at said first stroke condense at said plurality of cooling portions and making the liquid phase part of said working fluid displace toward the side of said plurality of the heating portions, and further comprising inflow adjusting means for reducing differences in inflows among said plurality of the heating portions, wherein the inflow is defined as the amount of a liquid phase part of said working fluid flowing into the heating portions when the liquid phase part of said working fluid displaces from said output part side to the side of said plurality of the heating portions in said second stroke.

2. An external combustion engine as set forth in claim 1, wherein said inflow adjusting means are formed so that flow resistances of the plurality of flow paths from the end of said blanched part at said merging pipe side to the end thereof at the side of said plurality of branch pipes respectively become the same.

3. An external combustion engine as set forth in claim 2, wherein said plurality of flow paths of said branched part become mutually symmetric shapes so that the flow resistances of said plurality of flow paths respectively become the same.

4. An external combustion engine as set forth in claim 1, wherein said inflow adjusting means are formed so that the flow resistance of said branched part is made smaller than the flow resistances of said cooling portions.

5. An external combustion engine as set forth in claim 4, wherein a length $l_{in}$ of the branched part, a hydraulic diameter $d_{in}$ of a flow path of the branched part, a length $l_r$ of the cooling portions, and a hydraulic diameter $d_r$ of a flow path of the cooling portions satisfy the following relationship:

$$l_{in}/d_{in} < l_r/d_r$$

where, $l_{in}$: length of branched part $d_{in}$: hydraulic diameter of flow path of branched part $l_r$: length of cooling portions $d_r$: hydraulic diameter of flow paths of cooling portions.

6. An external combustion engine as set forth in claim 1, wherein said plurality of branch pipes are provided with flow resistance adjusting means for making a flow resistance of a branch pipe at the side close to said output part larger than a flow resistance of a branch pipe at the side far from said output part, and said inflow adjusting means are said flow resistance adjusting means.

7. An external combustion engine as set forth in claim 6, wherein said plurality of branch pipes are provided with venturi, a resistance value of a venturi provided in a branch pipe at the side close to said output part is made larger than a resistance value of a venturi provided in a branch pipe at the side far from said output part, and said flow resistance adjusting means are said venturi.

8. An external combustion engine as set forth in claim 1, wherein at said plurality of heating portions, said inflow adjusting means are formed so that a heating portion at the side close to said output part is positioned above a heating portion at the side far from said output part.

* * * * *